US008267019B2

(12) United States Patent
Chen

(10) Patent No.: US 8,267,019 B2
(45) Date of Patent: Sep. 18, 2012

(54) FOLDABLE FRAME IMPROVED STRUCTURE FOR FOLDABLE TABLETOP OR BED

(76) Inventor: Te-Lung Chen, Tainan (TW)

( * ) Notice: Subject to any disclaimer, the term of this patent is extended or adjusted under 35 U.S.C. 154(b) by 651 days.

(21) Appl. No.: 12/291,213

(22) Filed: Nov. 10, 2008

(65) Prior Publication Data

US 2010/0116174 A1 May 13, 2010

(51) Int. Cl.
*A47B 3/083* (2006.01)
*A47B 3/00* (2006.01)

(52) U.S. Cl. ..... 108/169; 108/171; 108/132; 108/36

(58) Field of Classification Search ..... 108/14, 108/166–169, 171, 174, 126, 129–132, 34–36, 108/38, 147.2, 147.21; 190/1, 11, 12 R
See application file for complete search history.

(56) References Cited

U.S. PATENT DOCUMENTS

| | | | | | |
|---|---|---|---|---|---|
| 58,462 | A * | 10/1866 | Nellis | 108/36 |
| 164,824 | A * | 6/1875 | Fairchild | 108/131 |
| 915,061 | A * | 3/1909 | Arnt | 108/131 |
| 1,747,691 | A * | 2/1930 | Bellows | 108/129 |
| 2,643,926 | A * | 6/1953 | Pucci | 108/131 |
| 2,868,599 | A * | 1/1959 | Roggio | 108/36 |
| 2,937,062 | A * | 5/1960 | Kruse | 108/34 |
| 2,990,924 | A * | 7/1961 | Plunkett | 190/11 |
| 3,005,670 | A * | 10/1961 | Schultz | 108/35 |
| 5,647,286 | A * | 7/1997 | Dunn | 108/147.21 |
| 5,660,117 | A * | 8/1997 | Noble | 108/35 |
| 6,125,772 | A * | 10/2000 | Clements | 108/129 |
| 6,523,485 | B1 * | 2/2003 | Cipolla | 108/14 |
| 6,752,091 | B2 * | 6/2004 | Glover et al. | 108/168 |
| 7,140,308 | B2 * | 11/2006 | Tsai | 108/169 |
| 7,278,361 | B2 * | 10/2007 | Zhurong et al. | 108/168 |
| 7,337,728 | B2 * | 3/2008 | Shabram et al. | 108/35 |
| 7,752,982 | B2 * | 7/2010 | Lin | 108/168 |
| 7,950,337 | B2 * | 5/2011 | Chen | 108/115 |
| 2005/0274302 | A1 * | 12/2005 | Jin et al. | 108/126 |
| 2007/0101910 | A1 * | 5/2007 | Haimoff et al. | 108/169 |
| 2010/0116174 | A1 * | 5/2010 | Chen | 108/36 |

* cited by examiner

*Primary Examiner* — Darnell Jayne
*Assistant Examiner* — Daniel Rohrhoff

(57) ABSTRACT

A foldable table or bed comprises outer frames 1 and 2, leg frames 1 and 2, and leg frame expanding rods. Each outer side of the outer frames 1 and 2 is a flat panel of rectangular shape. Each inner side of the outer frames 1 and 2 is concave for containing leg frames 1 and 2 and leg frame expanding rods. The outer frames 1 and 2 are connected to each other with hinges on the ends of each adjacent side to form a case which can be folded and unfolded via the hinges. The leg frames 1 and 2 are inverted-square-bottomed-"U"-shaped and set in outer frames 1 and 2. Leg frame expanding rods are installed under each leg frame shaft to increase the height of the table.

2 Claims, 8 Drawing Sheets

FOLDABLE FRAME IMPROVED STRUCTURE FOR FOLDABLE TABLETOP OR BED

BACKGROUND OF THE PRESENT INVENTION

1. Field of the Invention

The present invention relates to an improved foldable table or bed, and particularly to a foldable frame structure for a foldable bed or tabletop, wherein outer frame 2 being folded into outer frame 1, and leg frame 1 capable of being folded underneath leg frame 2, forming a foldable frame improved structure for foldable tabletop or bed in one frame thick.

2. Description of Related Invention

As Shown in FIG. 1 and FIG. 2, a conventional foldable frame structure comprises a frame being folded on the top of another in order to make the frame structure pile up from the flat panels. However, it is still not capable of reducing its overall size and the core problems regarding bulky. Therefore, the inconvenience cannot be resolved.

To improve the shortcomings mentioned above, the inventor invented the prior art of U.S. Utility patent Ser. No. 12/074,311, which title is Foldable Frame Structure for Foldable Tabletop or Bed. The prior art mentioned above may provide the solution of the folding structure, however, it could not be regarded as a best frame structure. In order to improve the old frame structure, the inventor invented the present invention.

SUMMARY OF THE PRESENT INVENTION

The present invention relates to a foldable frame improved structure of the foldable table or bed which comprises outer frames 1 and 2, leg frames 1 and 2, and the leg frame expanding rods. Accordingly, each outer side of the outer frames 1 and 2 is a flat panel in rectangular shape, and the inner side is concave. A proper distance between the groove edge 2 on the concave of the outer frame 2 and the rim of the outer side is provided enables the outer frames 1 and 2 being staggered in a folded position. The length of the holding shaft 1 of the leg frame 1 is shorter than the length of the holding shaft 2 of the leg frame 2.

The invention has the following advantages:

First, a proper distance between the groove edge 2 on the concave of the outer frame 2 and the rim of the outer side is provided, and the length of the holding shaft 1 of the leg frame 1 is shorter than the length of the holding shaft 2 of the leg frame 2 to enable the outer frames 1 and 2 being staggered and keep the frame structure in one frame thick in a folded position.

Second, the present invention being folded is only in one frame thick. This will be capable of reducing its overall size, solving the core problems regarding bulky and being easily carried outdoors.

DETAILED DESCRIPTION OF THE PREFERRED EMBODIMENT

Figure 1:
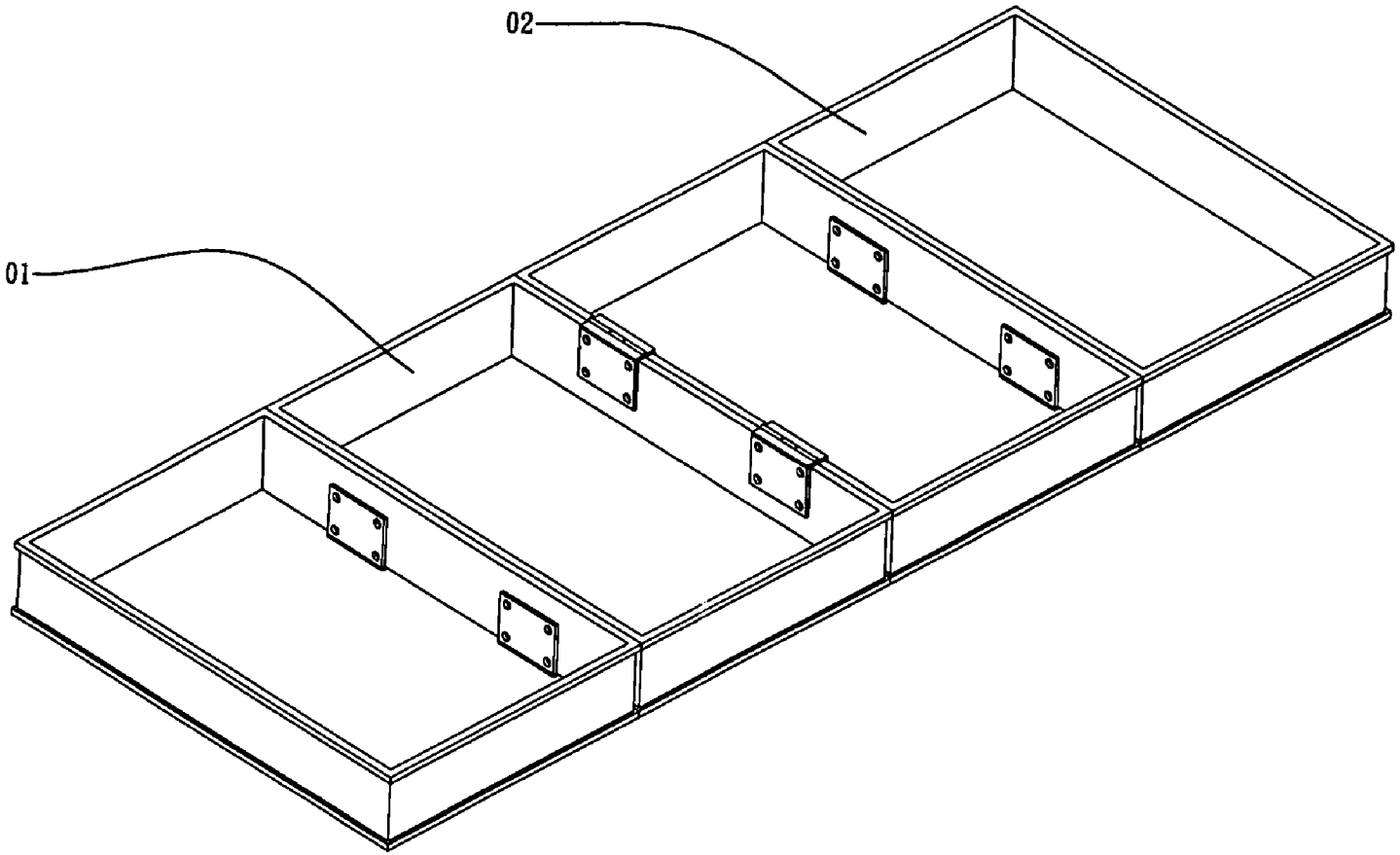
FIG. 1 PRIOR ART
FIG. 1 is perspective view of the conventional invention in an unfolded position.
Figure 2:
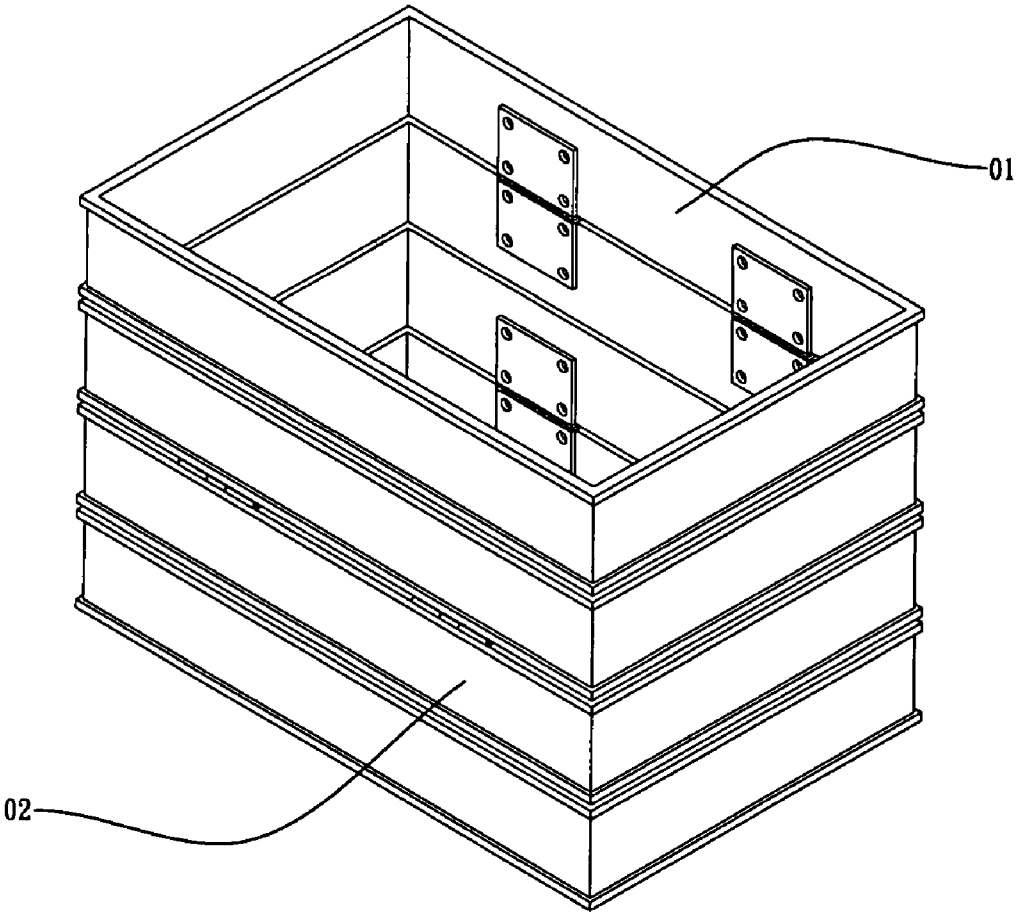
FIG. 2 PRIOR ART
FIG. 2 is a perspective view of the conventional invention in a folded position.

Referring to FIG. 3 to FIG. 12 of the drawings, a foldable frame improved structure of a foldable table or bed according to a preferred embodiment of the present invention is illustrated. The frame structure mainly comprises outer frame 1 (10), outer frame 2 (20), leg frame 1 (30), leg frame 2 (40) and leg frame expanding rods (50). Each outer side of the outer frame 1 (10) and outer frame 2 (20) is a flat panel in rectangular shape, and the inner side is concave for containing the leg frame 1 (30), leg frame 2 (40), and the leg frame expanding rods (50). The groove edge 1 (11) on the concave of outer frame 1(10) and the rim of the outer side are aligned. An installed set for leg frame 1(111) is on the side in the concave of outer frame 1(10). A proper distance between the groove edge 2 (21) on the concave of outer frame 2 (20) and the rim of the outer side is provided. An installed set for leg frame 2(211) is on the side in the concave of outer frame 2(20). The outer frame 1 (10) and outer frame 2 (20) are connected each other with the hinges (90) on the ends of each adjacent sides to form a case which can be folded and unfolded.

Figure 3:
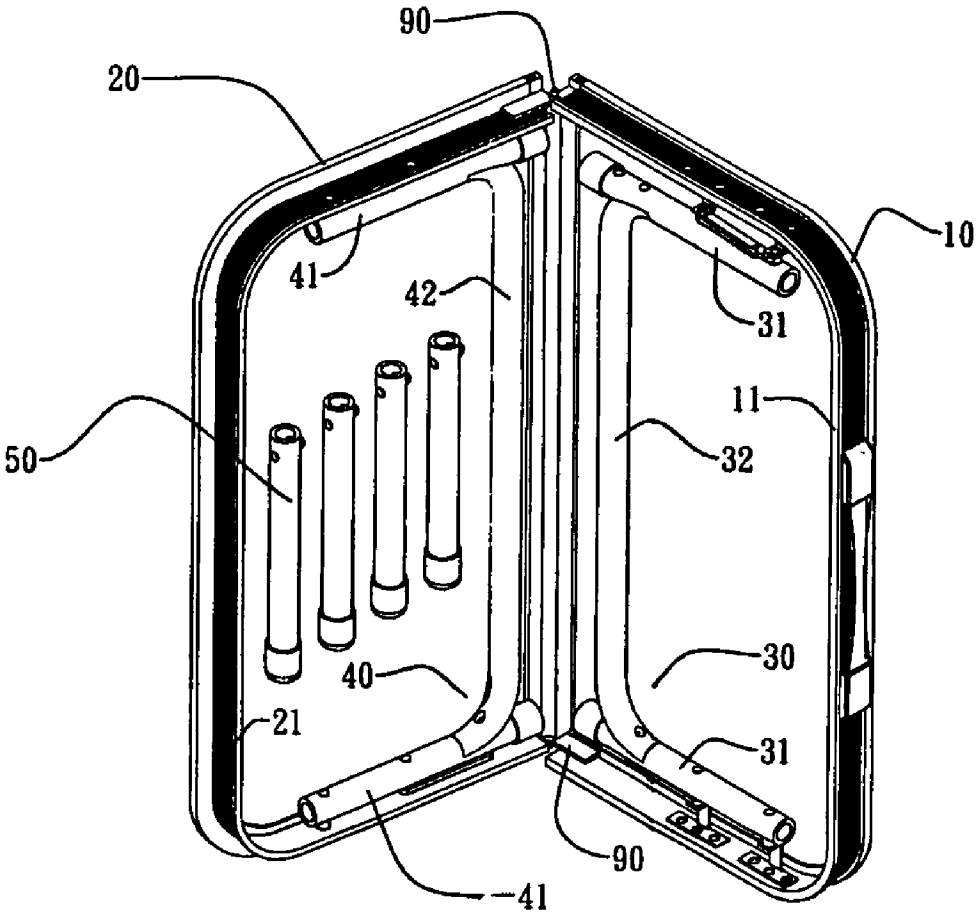
FIG. 3 is a schematic diagram of the present invention in half-unfolded position.
Figure 8:
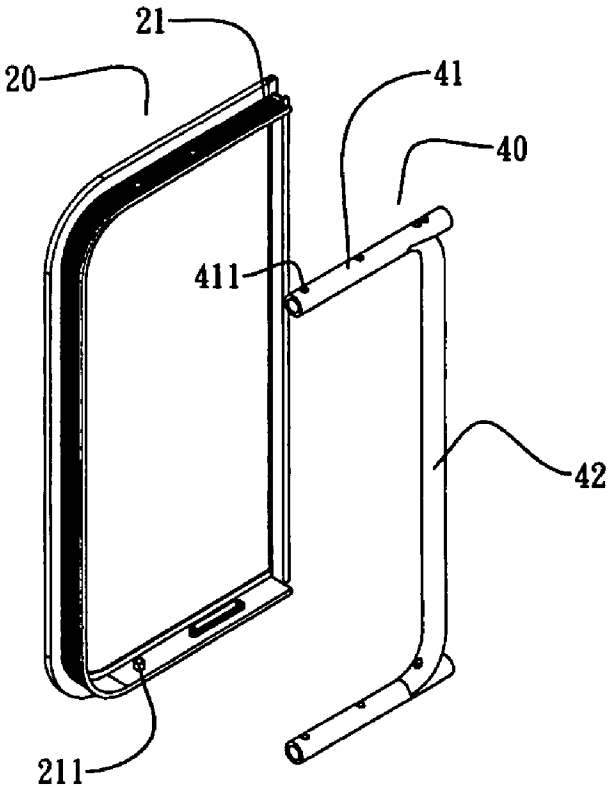
FIG. 8 is a schematic diagram of the present invention of outer frame 2 and leg frame 2.
Figure 7:
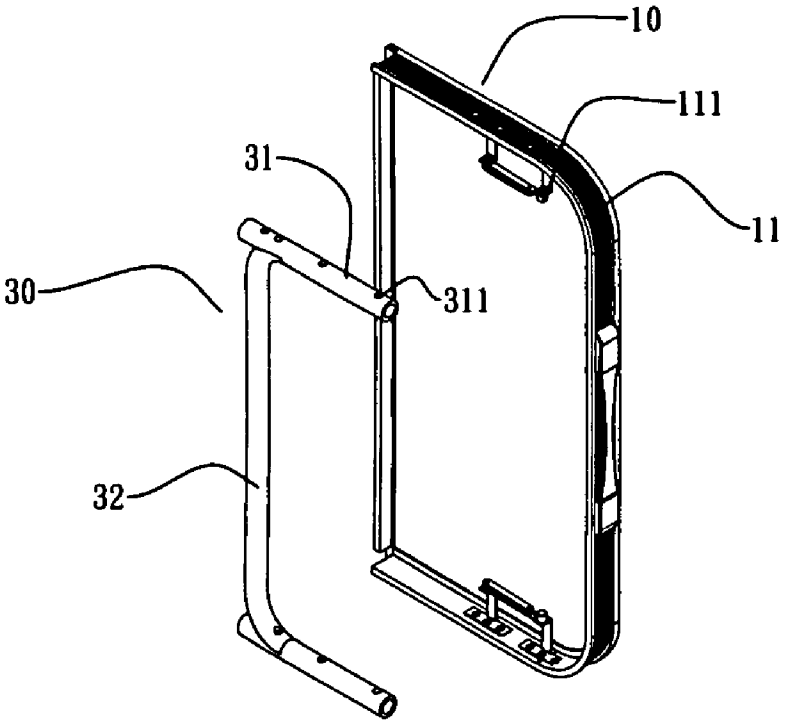
FIG. 7 is a schematic diagram of the present invention of outer frame 1 and leg frame 1.

As shown in FIG. 3, FIG. 7 and FIG. 8, the leg frame 1 (30) and leg frame 2 (40) are in ⊓-shape. The leg frame 1 (30) comprises 2 shafts 1 (31) and a holding shaft 1 (32) which is located between 2 shafts 1(31) and vertical with shafts 1(31). Installed holes on outer frame 1(311) are provided on shafts 1(31). Connect the installed holes on outer frame 1(311) and the installed sets for leg frame 1(111), and fulcrum the installed set for leg frame 1(111), so the leg frame 1(30) can be placed in outer frame 1(10) and can be folded and unfolded. The leg frame 2 (40) comprises 2 shafts 2 (41) and a holding shaft 2 (42) which is located between 2 shafts 2(41) and vertical with shafts 2(41). Installed holes on outer frame 2(411) are provided on shafts 2(41). Connect the installed holes on outer frame 2(411) and the installed sets for leg frame 2(211), and fulcrum the installed set for leg frame 2(211), therefore, the leg frame 2(40) can be placed in outer frame 2(20) and be folded and unfolded. Furthermore, the length of the holding shaft 1 (32) of the leg frame 1 (30) is shorter than the length of the holding shaft 2 (42) of the leg frame 2 (40), the height of the shaft 1 (31) of the leg frame 1 (30) is the same as the height of the shaft 2 (41) of the leg frame 2 (40).

Figure 5:
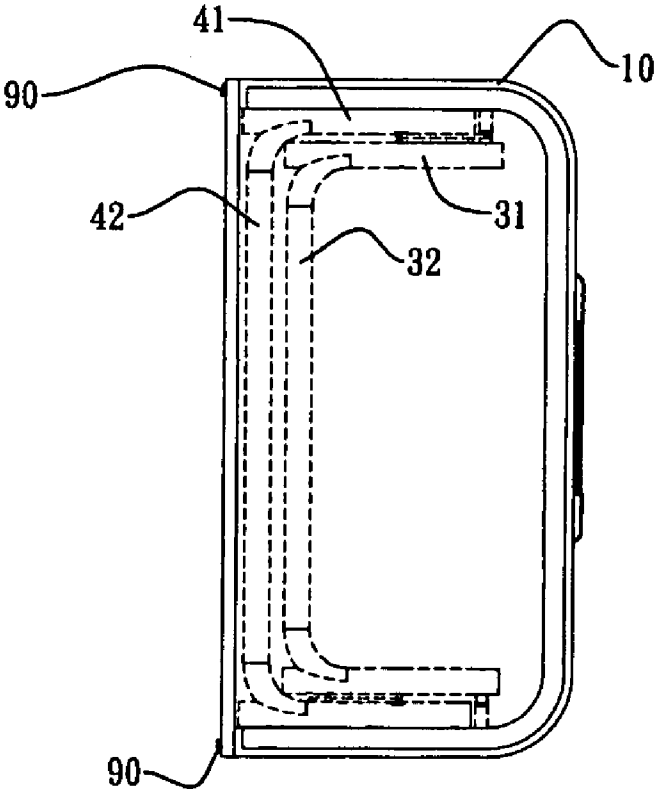
FIG. 5 is a perspective view of the leg frames in a folded position.
Figure 4:
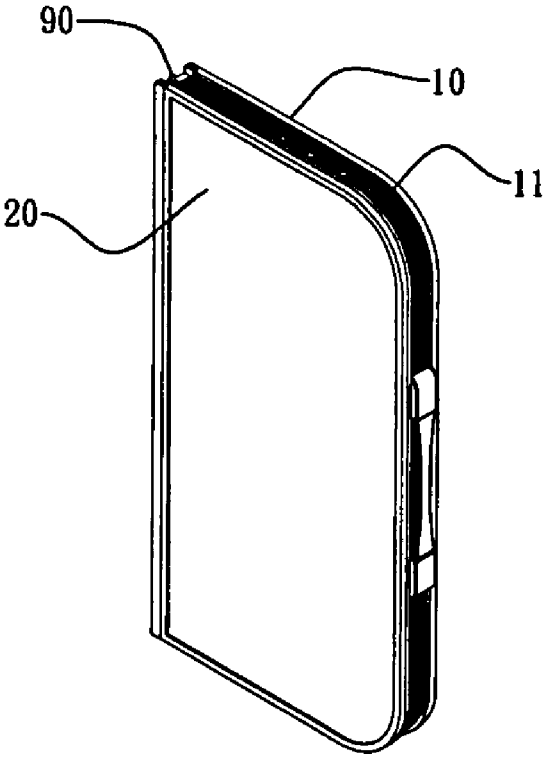
FIG. 4 is a schematic diagram of a preferred embodiment of the present invention, illustrating the folding position of the foldable frame structure.

As shown in FIG. 3, FIG. 4, and FIG. 5, when the frame structure is folded, a proper distance between the groove edge 2 (21) on the concave of the outer frame 2 (20) and the rim of the outer side is provided, it enables the outer frame 2 (20) being contained in the outer frame 1 (10). The length of the holding shaft 1 (32) is smaller than the holding shaft 2 (42), therefore, they could be staggered in a folded position.

Figure 6:
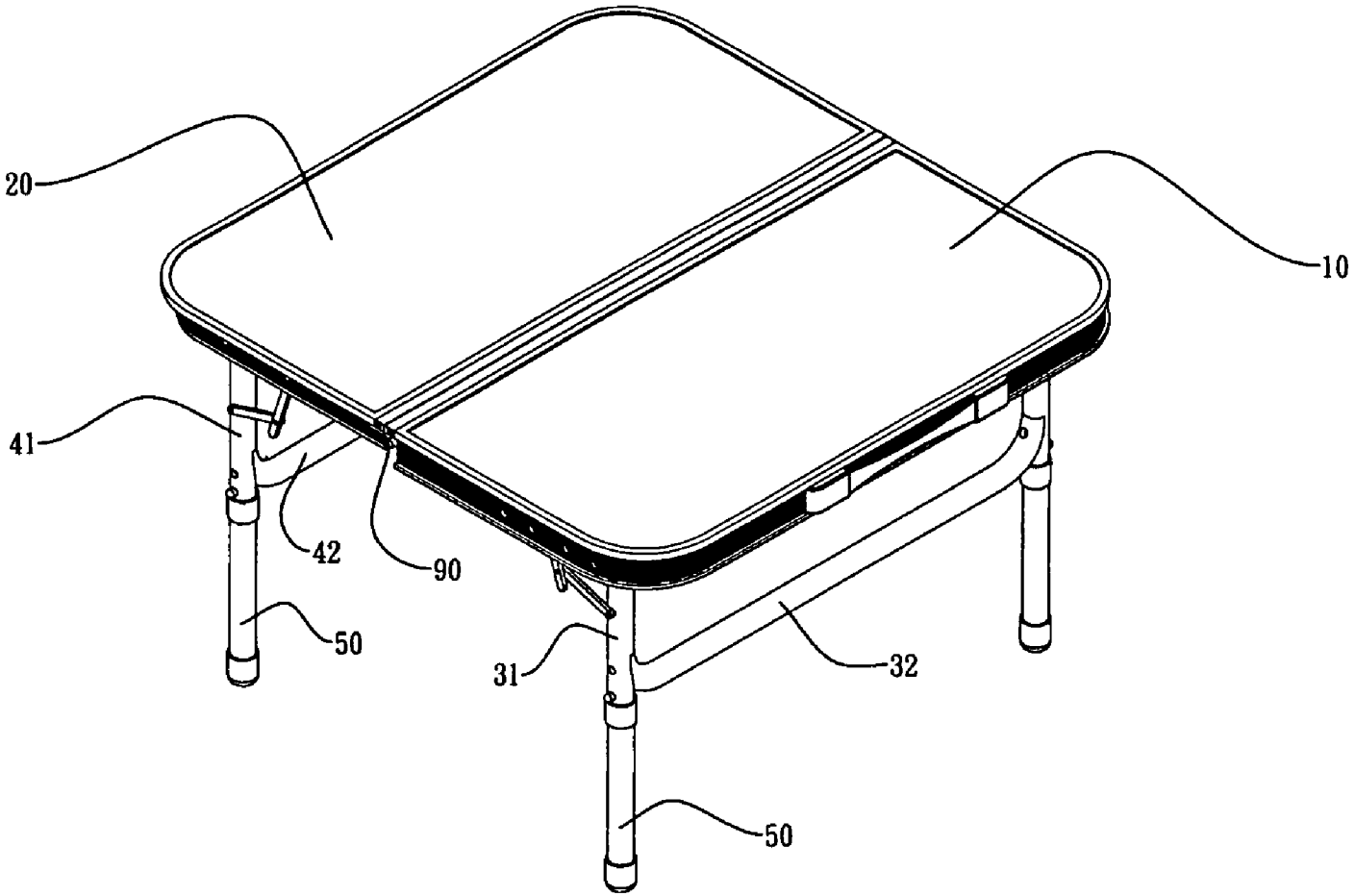
FIG. 6 is a perspective view of the present invention in an unfolded position.

As shown in FIG. 6, the outer sides of outer frame 1(10) and outer frame 2(20) are expanded to a flat surface in an unfolded position. Due to the length of the shafts 1(31) on the leg frame 1(30) and the shafts 2(41) on the leg frame 2(40) is the same, so the altitude of outer frame 1(10) and outer frame 2(20) is the same, when pulling down the leg frame 1(30) of the outer frame 1(10) and the leg frame 2(40) of the outer frame 2(20), a flat tabletop takes shape.

As shown in FIG. 6, the leg frame expanding rods (50) are separately installed under shafts 1(31) of the leg frame 1(31) and shafts 2(41) of the leg frame 2(40) to increase the height of the table.

Figure 10:
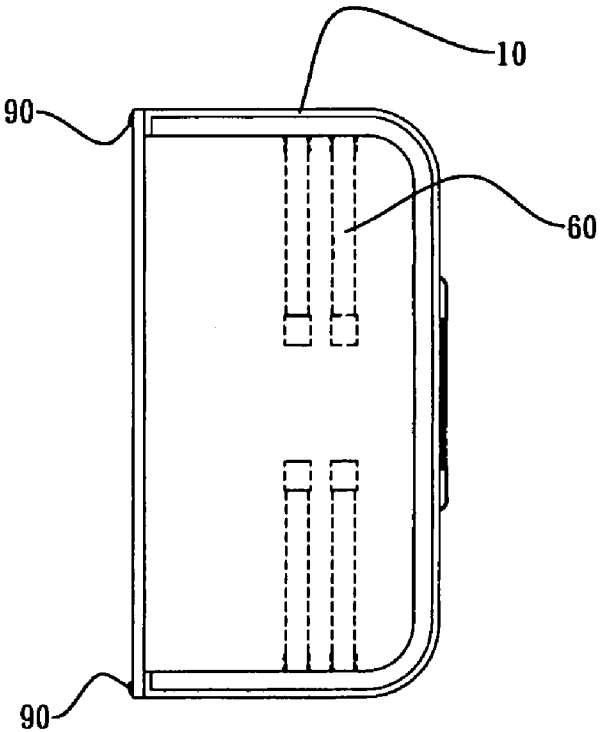
FIG. 10 is a schematic diagram of a preferred embodiment of the present invention, illustrating the leg frames in the foldable frame structure being folded in folded position.
Figure 9:
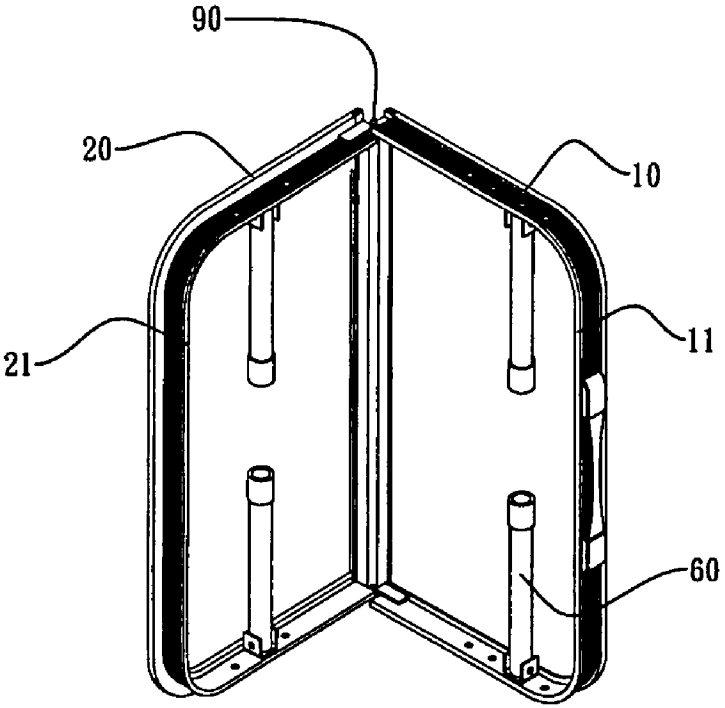
FIG. 9 is a schematic diagram of a preferred embodiment of the present invention, illustrating the leg frame expanding rods in the foldable frame structure being installed in half-unfolded position.

As shown in FIG. 9 and FIG. 10, this is the better example of the present invention. The leg frame 1(30) and leg frame 2(40) can be substitute by the leg rods (60). The leg rods (60) in outer frame 1(10) and the leg rods (60) in outer frame 2(20) are not installed symmetrically. Therefore, they are staggered in a folded position.

Figure 12:
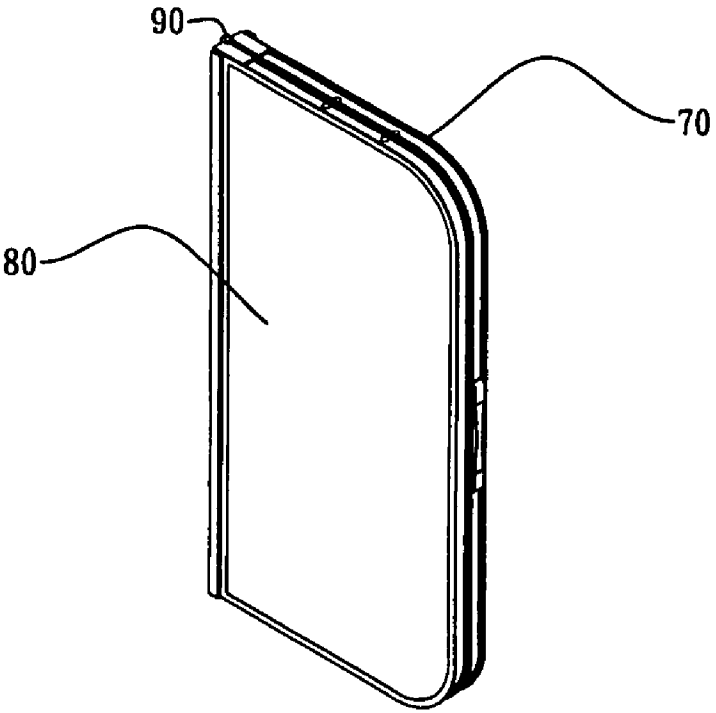
FIG. 12 is a schematic diagram of a preferred embodiment of the present invention, illustrating another folding position of the foldable frame structure.
Figure 11:
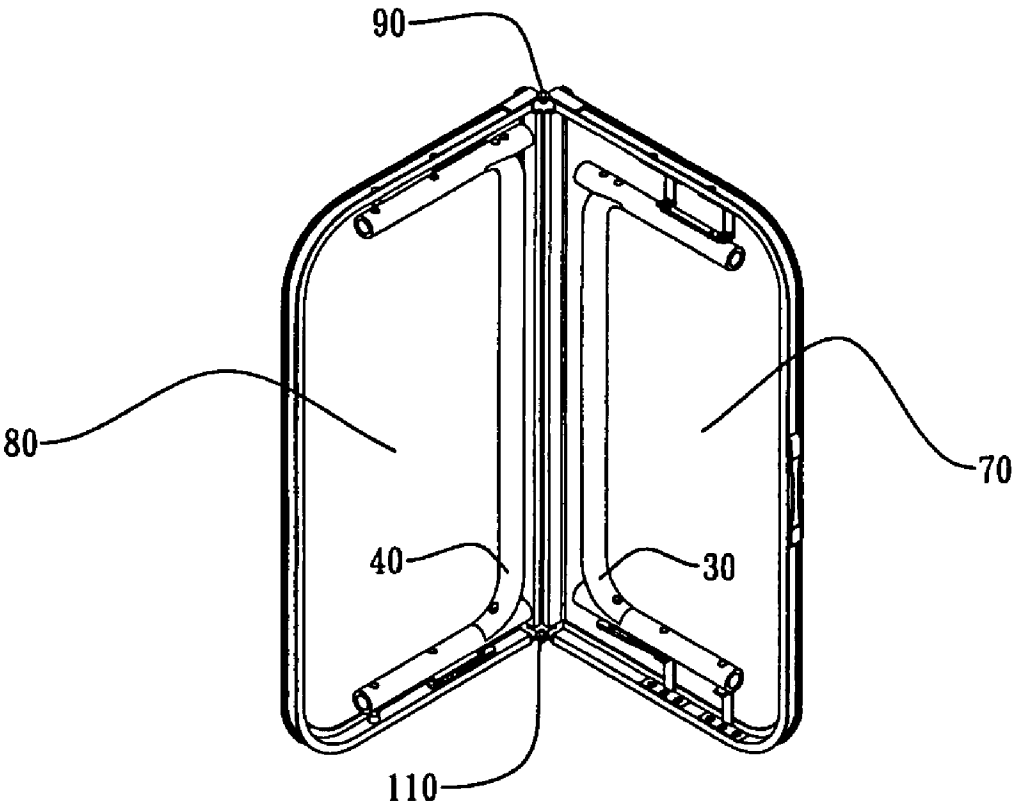
FIG. 11 is a schematic diagram of a preferred embodiment of the present invention, illustrating the leg frames in the foldable frame structure being folded in half-unfolded position.

As shown in FIG. 11 and FIG. 12, this is another better example of the present invention. The shape and the size of outer frame 3(70) and outer frame 4(80) is the same and symmetrical, and each thickness of outer frame 3(70) and outer frame 4(80) is half outer frame 1(10) and outer frame 2(20). The structure of leg frame 1(30) and leg frame 2(40) keeps the same, therefore, when outer frame 3(70) and outer frame 4(80) being folded, the structure has the same thickness in a folded position.

I claim:

1. A foldable horizontal support structure, comprising:

a first outer frame and a second outer frame, each outer frame having an outer side that is a flat rectangular panel and an inner side that is concave;

hinges which connect the first and second outer frames to each other to form a case which can be folded and unfolded;

a first leg frame and a second leg frame, the first and second leg frames having square-bottomed "U" shapes and being pivotably attached to the concave inner sides of the first and second outer frames, the first and second leg frames operable to fold against the first and second outer frames, respectively;

the first leg frame comprising a first shaft, a second shaft and a first holding shaft, the first holding shaft connecting and orthogonal to the first and second shafts;

the second leg frame comprising a third shaft, a fourth shaft and a second holding shaft, the second holding shaft connecting and orthogonal to the third and fourth shafts, the first leg frame sized and positioned to align with and nest within the second leg frame when the first and second outer frames are folded together to form a case, the first, second, third and fourth shafts pivoting to positions orthogonal to the first and second outer frames when the first and second leg frames and the first and second outer frames are unfolded;

a first groove edge disposed on a rim of the concave inner side of the first outer frame; and a second groove edge disposed on a rim of the concave inner side of the second outer frame, the second groove edge sized and positioned to align with and nest within the first groove edge when the first and second outer frames are folded together to form a folded case, the folded case having a thickness that is the sum of the thickness of the first outer frame and the thickness of the outer side of the second outer frame, the first and second outer frames and the first and second leg frames forming a horizontal support surface when the case is unfolded.

2. A foldable horizontal support structure as claimed in claim 1, further comprising leg frame expanding rods installed under the leg frame shafts, the installed leg frame expanding rods sliding within the leg frame shafts.

* * * * *